US008402600B2

(12) United States Patent
Beskow et al.

(10) Patent No.: US 8,402,600 B2
(45) Date of Patent: Mar. 26, 2013

(54) VACUUM CLEANER NOZZLE AND ROLLER

(75) Inventors: Jonas Beskow, Stockholm (SE); Anders Haegermarck, Trångsund (SE)

(73) Assignee: AB Electrolux, Stockholm (SE)

( * ) Notice: Subject to any disclaimer, the term of this patent is extended or adjusted under 35 U.S.C. 154(b) by 767 days.

(21) Appl. No.: 12/519,048

(22) PCT Filed: Dec. 13, 2007

(86) PCT No.: PCT/EP2007/010949

§ 371 (c)(1),
(2), (4) Date: Dec. 18, 2009

(87) PCT Pub. No.: WO2008/071427

PCT Pub. Date: Jun. 19, 2008

(65) Prior Publication Data

US 2010/0083460 A1 Apr. 8, 2010

Related U.S. Application Data

(60) Provisional application No. 60/869,797, filed on Dec. 13, 2006.

(51) Int. Cl.
*A47L 9/02* (2006.01)

(52) U.S. Cl. ..... 15/368; 15/378; 15/383; 15/419

(58) Field of Classification Search ..... 15/363, 15/378, 383, 419; *A47I 9/04*
See application file for complete search history.

(56) References Cited

U.S. PATENT DOCUMENTS

| | | | | |
|---|---|---|---|---|
| 2,397,537 | A | 4/1946 | Coss | |
| 4,129,920 | A | 12/1978 | Evans et al. | |
| 4,138,762 | A * | 2/1979 | Jost | 15/419 |
| 5,241,724 | A | 9/1993 | Lim | |
| 6,662,402 | B2 | 12/2003 | Giddings et al. | |
| 7,725,984 | B2 | 6/2010 | Jansen | |
| 7,979,952 | B2 * | 7/2011 | Beskow et al. | 15/322 |
| 2005/0039296 | A1 | 2/2005 | Yoshimura et al. | |
| 2005/0071948 | A1 | 4/2005 | Moshenrose | |

FOREIGN PATENT DOCUMENTS

| | | |
|---|---|---|
| EP | 0313403 A2 | 4/1989 |
| EP | 0338780 A2 | 10/1989 |
| GB | 2241430 A | 9/1991 |
| JP | 2007-105244 | 4/2007 |
| WO | WO 99/43250 | 9/1999 |

* cited by examiner

*Primary Examiner* — David Redding
(74) *Attorney, Agent, or Firm* — Hunton & Williams LLP

(57) ABSTRACT

A vacuum cleaner nozzle with a nozzle housing, an outlet opening on the housing, a suction opening on a side of the housing facing a surface to be cleaned, at least one roller connected to the housing to support the vacuum cleaner nozzle, and a sealing member on the nozzle. The suction opening communicates with the outlet opening to draw debris through the suction opening when a suction source is connected to the outlet. The roller has an essentially air tight material and rotates such that the roller surface moves towards the suction opening to sweep debris towards the suction opening. The sealing member has a sealing portion in close apposition to at least part of the roller. The sealing portion partly surrounds and substantially restricts airflow across a sealed portion of the roller located essentially opposite the surface being cleaned. The roller also functions as an air barrier.

20 Claims, 5 Drawing Sheets

VACUUM CLEANER NOZZLE AND ROLLER

The present invention claims priority to U.S. Provisional Application No. 60/869,797, filed Dec. 13, 2006, is the national stage of International Application No. PCT/EP2007/010949, filed Dec. 13, 2007, and claims priority as a continuation-in-part of U.S. patent application Ser. No. 11/956,178, filed Dec. 13, 2007, which is pending. The entire disclosures of all of the foregoing are incorporated herein by reference.

The invention relates to a vacuum cleaner nozzle of the kind being adapted to be moved over a floor or other surface to be cleaned, comprising an outlet opening, which is adapted to be connected to a vacuum source, a suction opening in a side of the vacuum cleaner nozzle facing the surface to be cleaned which is in fluid communication with the outlet opening to allow withdrawal of debris and dust from the surface through the suction opening, and at least one rotatable roller, which is adapted to at least partly support the vacuum cleaner nozzle against the surface and is formed of an essentially air tight material.

The invention also relates to a roller for such a vacuum cleaner nozzle and a vacuum cleaner comprising such a vacuum cleaner nozzle.

BACKGROUND OF THE INVENTION

In prior art is known many different types of vacuum cleaner nozzles for floor cleaning. One object with a vacuum cleaner nozzle is to pick up as much as possible of different kinds of debris and dust from all different kinds of surfaces, such as hard floors or carpets, with as little effort as possible.

A common feature for all kinds of vacuum cleaner nozzles, is that some kind of means has to be provided in order to achieve an optimal combination of vacuum and airflow with high speed around the particles to allow withdrawal by the airflow into the suction opening. This is normally achieved by arranging a bottom plate of the nozzle close to a surface to be cleaned, often also in combination with surrounding the bottom plate area with a low edge, often provided with bristles, which restricts the air flow to the suction opening and forces the air flow as close to the floor as possible. The edge of bristles is normally retracted when cleaning carpets such that the bottom plate is sliding directly onto the carpet in order to draw the air flow between the carpet fibers. However, a vacuum cleaner nozzle arranged in this way involves some disadvantages. For example, a low front edge, such as an edge of bristles results in that larger particles often are pushed in front of the nozzle when moving it over a surface to be cleaned. A low bottom plate distance to the floor increases pick-up from depth, crevices, in between tiles, etc, but also increases the risk for scratching the floor. A strong vacuum underneath the nozzle increases air speed but also the resistance when moving the nozzle. High air speed results in good debris pick-up but also creates more noise.

Many vacuum cleaner nozzles comprises a setting mechanism for setting between the different modes when vacuum cleaning of carpets and hard floors, such that when vacuum cleaning of carpets, the bottom plate is closer to and often slides on the carpet surface in order to draw the air flow between the carpet fibers, whereas when vacuum cleaning of hard floors, the bottom plate is elevated on a distance from the floor surface and the vacuum cleaner nozzle is moved over the surface by sliding on felt or bristle members or rolling on wheels. Such a setting mechanism will of course increase the costs for the vacuum cleaner nozzle and it involves an additional inconvenience for the user to perform the setting.

Some vacuum cleaner nozzles are of an active kind having a rotary driven brush in contact with the surface to be cleaned, in order to achieve a higher degree of pick-up of debris and dust, especially on carpets. However, also when using a rotatable brush, the nozzle has to be provided with a low edge, e.g. of bristles or hard plastics, in order to restrict the air flow towards the suction opening, since a rotatable brush is highly air permeable. This has to effect that also here the pick up of larger items is prevented unless the nozzle is lifted from the surface. Also, when using a rotatable brush on hard floors, it is a risk that the brush will damage the floor during long time use, since bristles in rotatable brushes often are made of a comparatively hard material in order to achieve a sufficient stiffness. Moreover, dust and long flexible items, such as threads and hair, tend to adhere easily to brushes and be difficult to remove. Normally, an actively rotary driven brush is driven at about 3000 rpm (revolutions per minute), which will lead to a tendency for particles to be swept aside instead of being picked up by the nozzle.

In EP 313403 and 338780 is disclosed vacuum cleaner nozzles having a rotatable shaft provided with flexible blades arranged helically around the circumference of the shaft. The rotatable shaft is positioned at the bottom side of the nozzle in front of an air intake opening and an object is to provide an agitator roller, which do not present the usual problem, associated with rotatable brushes, that elongated items, such as threads and hair, tend to get entangled with the bristles of the brush. In all other respects the agitator rollers disclosed in these documents present the same disadvantages associated with rotatable brushes. For example, an agitator roller formed in this way is highly air permeable, such that the nozzle has to be provided with a low front edge, in order to restrict the air flow towards the suction opening, wherein the low front edge will prevent pick up of large items.

Also in WO 9943250 is disclosed a vacuum cleaner nozzle having a rotatable shaft provided with elongated, flexible blades or strip-shaped elements, such as brush strips or blades of rubber or plastics, around the periphery of the shaft. The nozzle is arranged such that, when cleaning hard floors, the outer edges of the blades will not be in contact with the floor but will rotate on a distance above the floor. This is a disadvantage since thereby is not achieved any polishing effect of the floor surface, which would be the case if the blades were in contact with the floor. Moreover, a roller of this kind being provided with flexible blades, is not adapted to wholly or partially support the nozzle against the floor. Instead, the nozzle has to be provided with separate wheels, sliding surfaces or the like. This has to effect that the roller can not follow any irregularities in the floor so well, such that if the floor has any cavities or the like, the roller might pass on a rather large distance from the bottom of the cavity. This will result in a lowered air velocity and deteriorated ability to pick up debris. Also the ability for the nozzle to climb up on edges, such as carpet edges, will be poor if the roller can not support the nozzle. A rotating roller having blades, wings or fins will also generate quite a lot of noise, which is a great disadvantage when vacuum cleaning at the same time as other activities is going on in the same or adjoining rooms.

In US 2005/0071948 is disclosed an attachment for a vacuum cleaner nozzle. The attachment is provided with two rollers and is adapted to be combined with nozzles having a rotatable driven brush. More precisely, a nozzle is to be positioned on top of the attachment, such that the driven brush is in contact with the rollers and the rotary motion of the brush will be transferred to the rollers. The purpose is that the nozzle alone should be used on carpets, since the rotatable driven brush is well suited to pick up debris and dust from between the carpet fibers, whereas the nozzle together with the attachment should be used on hard floors. Besides that the combination of the nozzle and the attachment will be very cumbersome to use, since it will have a considerable height which will make it impossible to vacuum clean under furniture and the like, the rollers will be driven in the same direction, having to effect that one of the rollers will sweep the debris and dust towards the suction opening, whereas the other roller will sweep the debris and dust away from the suction opening. Also, the rollers are mounted in the attachment with rather large gaps between the portions of the rollers which are facing outwards and the attachment, such that an essential part of the air flow will go this way. Accordingly, the cleaning effect will be poor.

In the Japanese published patent application 2007-105244 is disclosed a cleaning roller consisting of an inner core on the outer periphery of which is provided a foamed body. The foamed body is preferably of polyurethane foam and has a thickness of at least 5 mm. The outer periphery of the foamed body is cylindrical with a circular cross section and the surface is provided with 10 to 40 open pores per 25 mm. The object of the cleaning roller is that debris and dust shall adhere to the open pores of the roller surface when moving the roller over the surface to be cleaned. The cleaning roller is illustrated as being mounted onto a handheld cleaning tool, such that the roller can be moved over the surface to be cleaned by hand. However, it is mentioned in the specification that the cleaning roller also could be arranged at a dust suction opening of a vacuum cleaner.

SUMMARY OF THE INVENTION

It is an object of the present invention to provide a vacuum cleaner nozzle, which presents improved suction characteristics and which is more capable of picking up also rather large items. At least this object is achieved by a vacuum cleaner nozzle according to claim 1.

The invention also relates to a roller and a vacuum cleaner having essentially the same object as above.

Accordingly, the basis of the invention is the understanding that the above object may be achieved by providing the vacuum cleaner nozzle with a roller, which is adapted to at least partly support the vacuum cleaner nozzle against the surface to be cleaned and is formed of an essentially air tight material. The roller is either an idle roller, which is rolling along as the nozzle is moved over the surface, or is driven in a direction of rotation such that a portion of its envelope surface, which is facing the surface to be cleaned, is moved towards the suction opening to accomplish sweeping of debris and dust towards the suction opening. The rotatable roller is partly surrounded by a sealing member close to the envelope surface of the roller, along a portion of its circumference which is located essentially opposite the surface to be cleaned such that air flow around the portion of the envelope surface located opposite the surface to be cleaned is restricted and such that the roller functions as a rotatable air barrier, which restricts and controls the air flow to the suction opening and forces the main part of the air flow to pass close to the surface to be cleaned.

By means of a vacuum cleaner nozzle arranged according to the invention, since the roller at least partly supports the nozzle, the advantage is achieved that the roller accomplishes a polishing effect of the surface to be cleaned. Also, the roller will follow any irregularities in the surface, such that the roller will maintain contact with the surface even over cavities, which will create a sufficient air velocity to withdraw debris and dust, and the nozzle will more easily climb up on edges, such as carpet edges and the like. The feature that the roller at least partly supports the nozzle does not preclude that the nozzle also comprises wheels or sliding surfaces. However, it involves that at least some pressure is applied on the roller against the surface and it involves that the roller has to be of a kind that can bear the pressure. This excludes brush rollers and rollers having thin blades, wings, fins or the like, since such elements will be deformed, at least during long time use. In some appliances the roller can be strictly cylindrical. However, it is preferred that the envelope surface of the roller is formed with a suitable structure, such that a sufficient air flow can be achieved between the roller and the surface during use. Accordingly, the total contact surface of the roller towards the surface is at least 30%, preferably at least 40% and most preferably at least 50% of the total envelope surface of the roller. Moreover, if the roller is actively rotationally driven, the rotational direction will accomplish sweeping of debris and dust towards the suction opening. Since the roller is partly surrounded by a sealing member close to the envelope surface of the roller, along a portion of its circumference which is located essentially opposite the surface to be cleaned, the air flow around that portion of the envelope surface will be restricted. Accordingly, the roller can be used as a rotatable air barrier, such that a low edge outside the roller can be dispensed with, which has the effect that also rather large debris items can be withdrawn by the nozzle without having to lift the nozzle from the surface.

Within the general idea, the invention may be varied in many different ways. In a hereinafter described and illustrated embodiment, the vacuum cleaner nozzle is provided with one single, actively rotationally driven roller at a forward edge. The roller is moreover formed with a structured envelope surface, such that air passages will be formed between the roller and the surface to be cleaned. More precisely, the structure on the envelope surface is formed by several grooves, which extend helically over the envelope surface. As the roller rotates, the air passages between the roller and the surface will accordingly move successively along the length of the roller. In this way the air flow is concentrated, in a favorable way, to confined spots or passages, such that either the total air flow quantity can be decreased to save energy, or by maintaining the total air flow quantity the suction and cleaning effect can be increased.

However, a vacuum cleaner nozzle according to the invention can be provided with more than one roller. For example one rotationally driven roller at the forward edge and an idle roller or a likewise rotationally driven roller in the area behind the suction opening in order to control the air flow from behind. Also, the nozzle can be provided with rollers, idle or driven, at each side in order to control the air flow from those directions and to facilitate moving the nozzle sideways if desired. In fact all the rollers can be rotationally driven, according to the invention in a direction such that a portion of their envelope surfaces, which are facing the surface to be cleaned, is moved towards the suction opening. Opposite rollers will accordingly have opposite directions of rotation. However, this is not a disadvantage when moving the nozzle over the surface, since as each roller is rotated, the contact friction between each roller and the surface will be lowered which will make it easy to move the nozzle in all directions. The invention is not restricted to four rotationally driven rollers in a square form. It would also be possible to arrange several short rollers in e.g. a hexagon or octagonal form. It is preferred that at least some of the rollers have structured envelope surfaces, in order to form air passages between the roller and the surface to be cleaned, while the other rollers can have smooth cylindrical envelope surfaces. One advantage with a vacuum cleaner nozzle according to the invention, formed in one of the above described or any other way, is that a low air flow restricting edge in the area of each roller can be dispensed with, which will facilitate pick up of particularly large debris items.

The sealing member close to the envelope surface of the roller, along a portion of its circumference which is located essentially opposite the surface to be cleaned, can be formed in different ways. In the described and illustrated embodiment, the sealing member is a roller housing, having an inner surface located close to the envelope surface of the roller. However, it could also be e.g. a flexible or hinged member which abuts and slides against the envelope surface as the roller rotates. It is to be understood that the term "essentially opposite" in this context, does not necessarily mean strictly diametrically opposite. Instead it should be interpreted as being on the side or the roller facing away from the surface to be cleaned.

The roller can be manufactured of many different materials. Normally it is preferred to use a resilient, easily deformable material, such as a foam material, in at least an outer layer of the roller. It is also preferred that at least an outer layer or the roller is unitary made in one piece of a resilient material.

The foam material, which can be of e.g. polyurethane or polyester, can be manufactured to a low cost and is easy to form with the desired structure. However, also other materials could be conceivable, such as a fibrous material. Due to the resilient layer on the roller, it is also easier to pick up larger items in that the resilient layer will be deformed over the item such that it can pass beneath the roller. Thanks to the resilient layer it is also easier to clean uneven surfaces since the layer will conform to the surface. Preferably, the envelope surface of the roller is sealed, such that it do not contain any open pores in which debris and dust can get stuck and such that it is air tight for increased suction effect through the air passages between the roller and the surface. The thickness of the resilient layer is between 5-25 mm, preferably 10-20 mm and most preferred about 10 mm. However, it is also possible to form the roller of a material that is not so easy to deform, such as rubber or plastics.

The structure forming the air passages can have many different shapes, such as helically formed grooves or projections distributed over the envelope surface. One advantage with a structure in form of helical grooves, which can be continuous over the whole or only a part of the roller length, is that during vacuum cleaning the air passages will move continuously over a part of or the entire length of the roller as it is rotated, such that the air flow will strike sequentially over the surface to be cleaned, which will drive the debris and dust in a favorable way towards the inlet slot. If the pitch of each helical groove is not too steep, the sealing member at a portion of the envelope surface which is located essentially opposite the surface to be cleaned, can be made to cover at least one whole groove which will reduce air leakage between the sealing member and the roller. However, the structure of the envelope surface can be made in many other shapes, such as confined projections from or recesses in the envelope surface.

Normally, it is preferred that an actively driven roller is driven by means of an electric motor or a turbine. However, it is also possible to drive the roller by means of wheels, which are in contact with the surface to be cleaned and rotates as the nozzle is moved over the surface. An electric motor can either be positioned inside the roller or outside the roller by driving via a belt or the like. One advantage by having an actively driven roller is that it will have a brushing effect on the surface to be cleaned. Another is that the nozzle will be self propelled in for example the forward direction, which will facilitate the cleaning work. The roller is preferably driven at 400 to 600 rpm (revolutions per minute) or at about 500 rpm. This is a rather low rotary speed in comparison to prior art vacuum cleaner nozzles, and reduces the risk that debris and dust will be thrown aside by the rotating roller. However, it is also conceivable to let the roller be an idler roller, which is not driven but merely rotates along when the vacuum cleaner nozzle is moved over the surface. In such a case the roller functions as an air barrier, which restricts and controls the air flow to the suction opening and, when having a structured envelope surface, for forming of air passages between the envelope surface and the surface to be cleaned.

Preferably, each roller is easily replaceable by another roller, e.g. when the used one is worn out or when it is desirable to use a roller having another structure pattern on the envelope surface. In an alternative embodiment of a roller, the structure pattern on the roller envelope surface could be combined with bristles, e.g. bristles arranged in grooves around the surface.

It is to be understood that a vacuum cleaner nozzle according to the invention, can be applied in all kinds of vacuum cleaners, such as stick-type, canister-type and central vacuum cleaners. Due to the increased performance of the vacuum cleaner nozzle according to the invention, it is especially well suited for battery powered vacuum cleaners, but can of course be used also in vacuum cleaners connected to mains supply. Normally, vacuum cleaners are utilized to vacuum clean horizontal surfaces, such as floors. However, the invention is applicable also in vacuum cleaner nozzles for other purposes. For example vacuum cleaner nozzles adapted for vacuum cleaning of stairs and furniture with a suction opening is located in a vertical side of the nozzle.

BRIEF DESCRIPTION OF THE DRAWINGS

Hereinafter an exemplary embodiment of the invention will be described by reference to the drawings, in which.

DETAILED DESCRIPTION OF AN EMBODIMENT OF THE INVENTION

Figure 1:
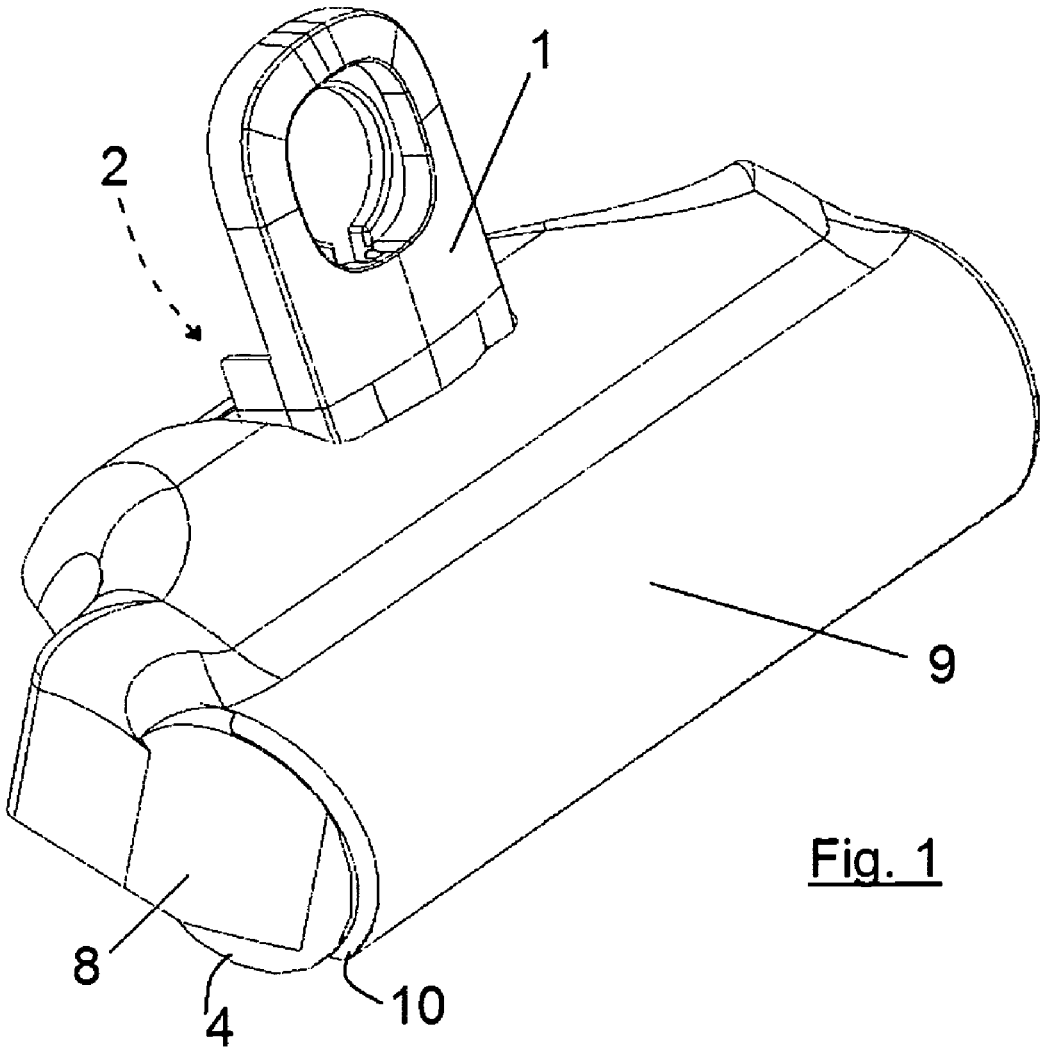
FIG. 1 is a perspective view from above of a vacuum cleaner nozzle according to the invention.
Figure 3:
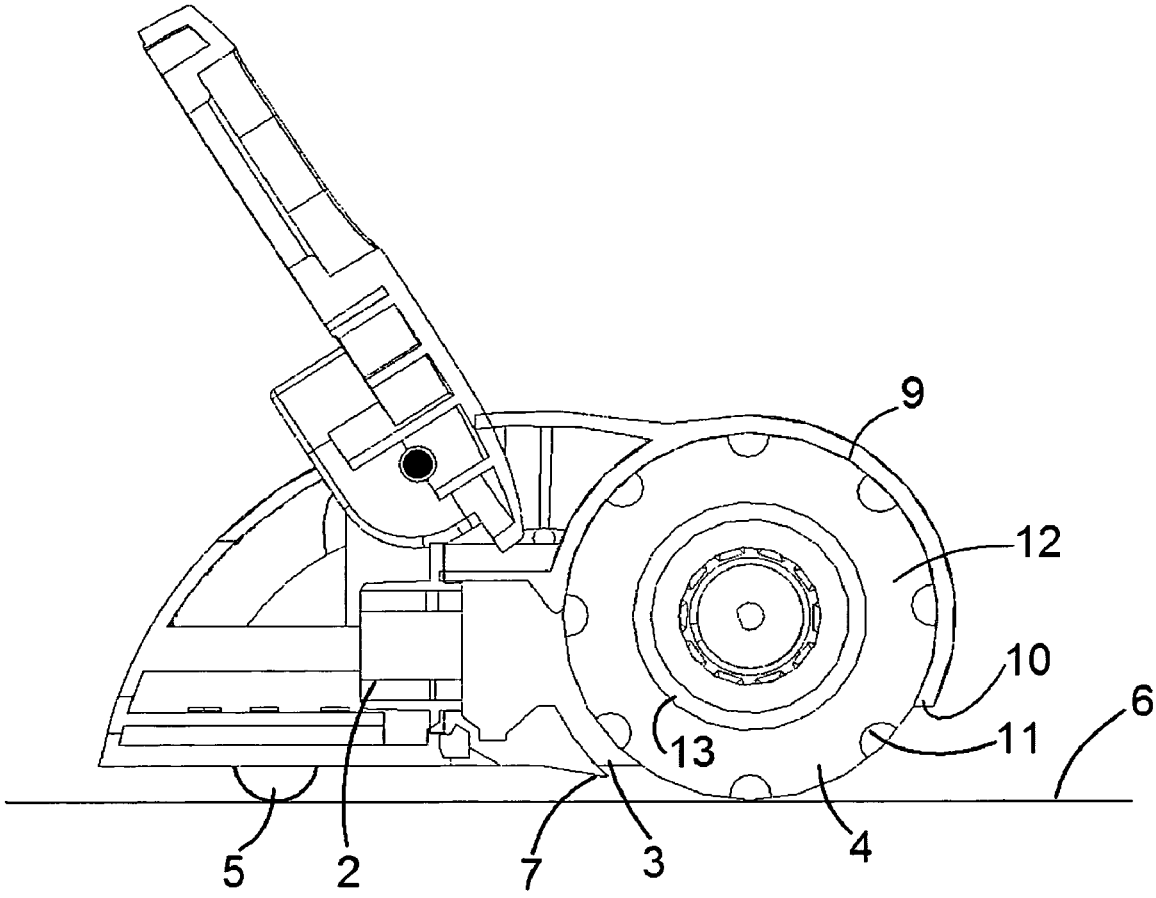
FIG. 3 is a cross section through the nozzle in FIGS. 1-2.

Reference is first made to the perspective view in FIG. 1, illustrating an embodiment of a vacuum cleaner nozzle according to the invention, which is adapted to be connected to a so called stick-type of vacuum cleaner. For this reason the nozzle comprises a pivotal mounting bracket 1 for connecting to one end of the stick of the vacuum cleaner. The nozzle comprises an outlet opening 2, as is best seen in FIG. 3, the end of which is located within an outer casing of the nozzle and to which a flexible vacuum tubing is to be connected. Through the flexible tubing an air flow is drawn by means of a vacuum source in form of a motor and fan unit in the vacuum cleaner, as is common knowledge in the art.

Figure 2:
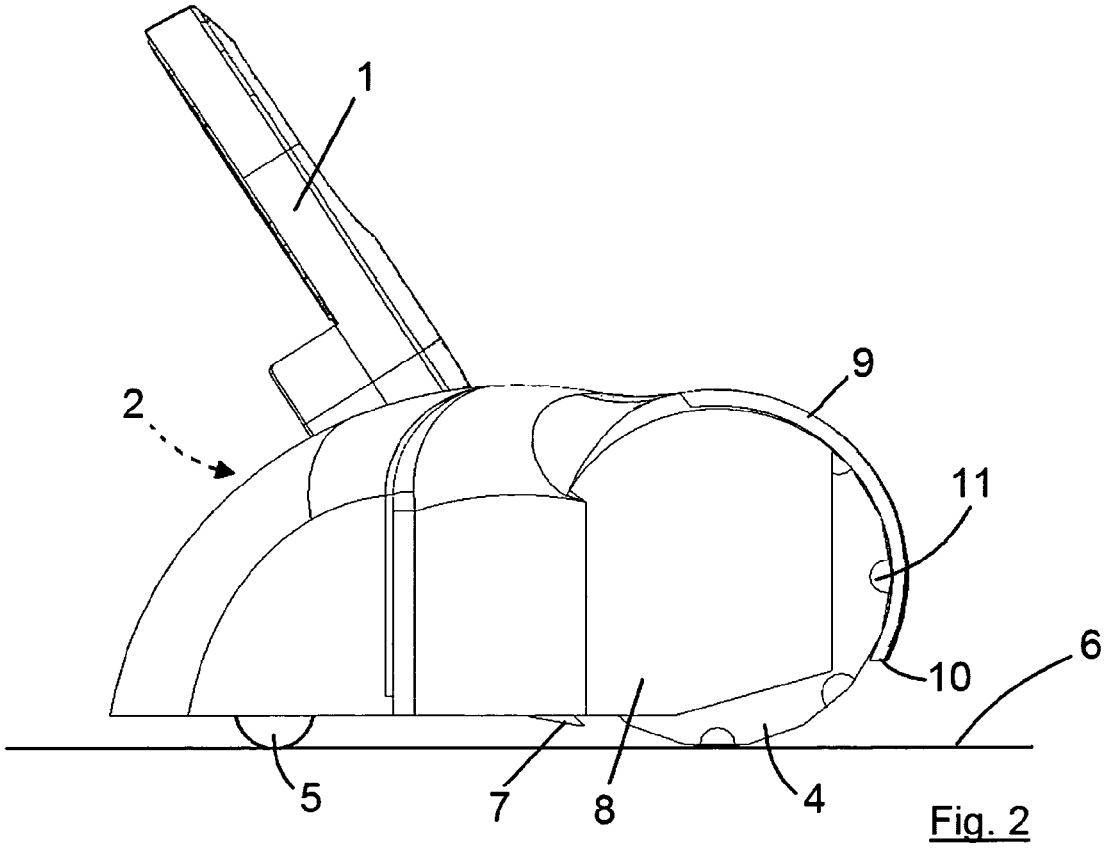
FIG. 2 is a side view of the nozzle in FIG. 1.
Figure 4:
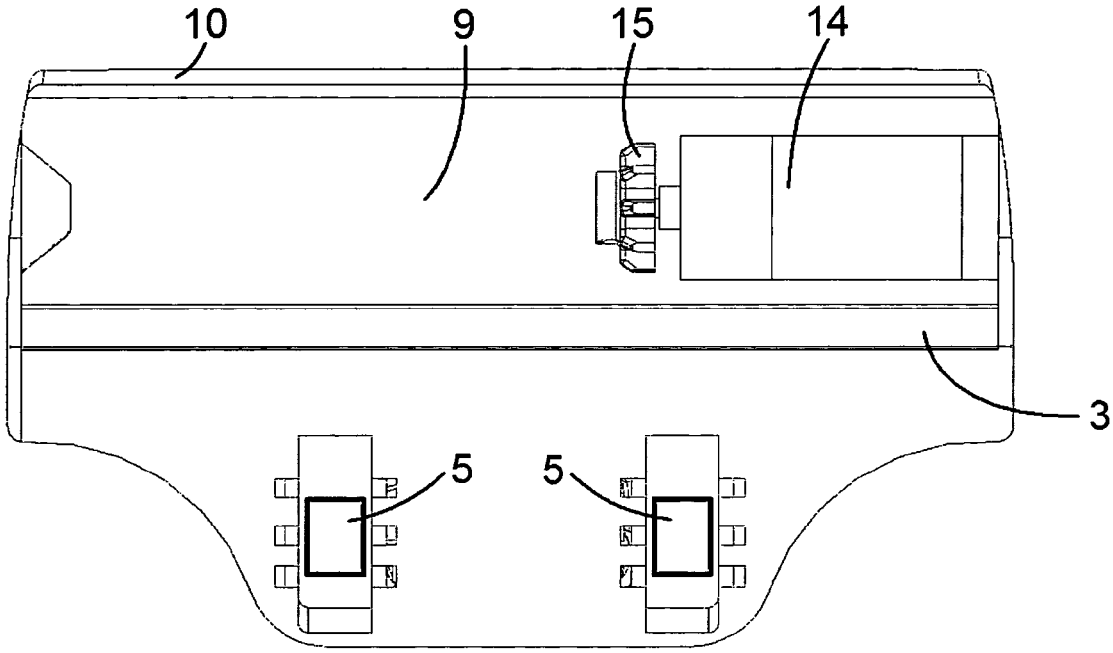
FIG. 4 is a bottom view of the vacuum cleaner nozzle but with the roller removed.

Reference is then made to FIGS. 2-4 for a more detailed description of the nozzle structure. The vacuum cleaner nozzle comprises a suction opening 3, which in this embodiment is formed as an elongated slot, a rotatable roller 4, which is positioned along a forward edge of the nozzle in front of and in parallel to the suction opening 3, and two wheels 5. The suction opening 3 is in fluid communication with the outlet opening 2, such that when the outlet opening 2 is connected to a vacuum source, debris and dust beneath the nozzle can be drawn in through the suction opening by means of the air flow generated by the vacuum source, while moving the nozzle over a surface 6 to be cleaned, e.g. a floor. The roller 4 is rotatably driven by means of an electrical motor, as will be described more in detail further on, such that the roller rotates clockwise as seen in FIGS. 2 and 3, i.e. the lower envelope surface of the roller, which is facing the surface 6, is moved inwards towards the suction opening 3. In this way the roller will sweep any debris and dust on the floor 6 towards the suction opening 3 at the same time as the roller will drive the nozzle forward, i.e. in the direction to the right in FIGS. 2 and 3.

As can be seen from the cross section in FIG. 3, the suction opening 3 is defined between a rear edge 7, which is positioned with a small distance to the surface 6, and the roller 4. Accordingly, the roller 4 will function as a rotary air barrier, which will restrict the air flow to the suction opening 3. The casing is moreover formed with side wall portions 8 arranged at each end of the suction opening 3 and the roller 4, as seen in FIG. 2, which will restrict the air flow from each side to the suction opening.

At the side of the roller 4 which is located essentially opposite the floor 6, the roller is partly surrounded by a sealing member in form of a roller housing 9 having a sub-cylindrical inner surface positioned close to the envelope surface of the roller. In this way air flow above the roller will be restricted. The roller housing 9 terminates at a forward edge 10.

Figure 5:
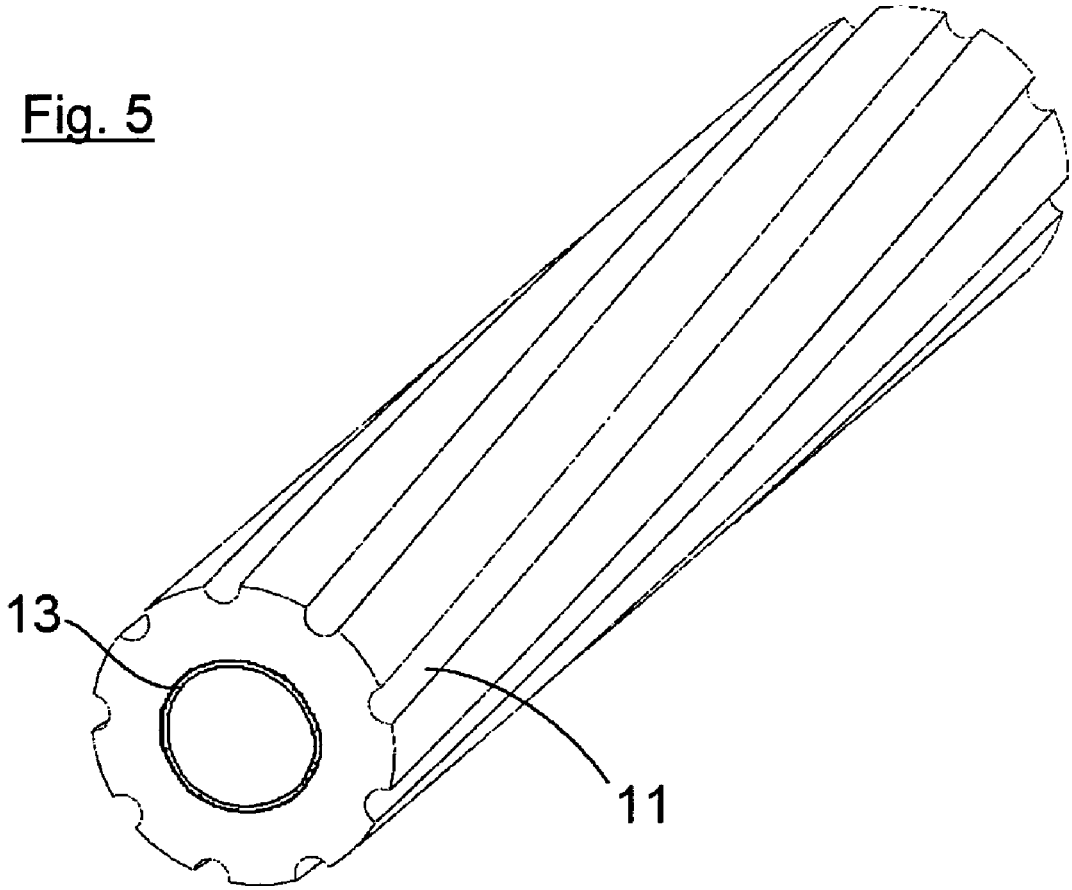
FIG. 5 is a perspective view of the roller.

However, to achieve a good cleaning effect it is not sufficient to create a strong vacuum. It is also necessary to let in an appropriate amount of air such that an air flow is generated, preferably as close to the floor as possible, which has a sufficient velocity to withdraw the debris and dust into the suction opening. In the embodiment shown, the air flow into the suction opening 3 is partly taken in below the rear edge 7 and beneath the side wall portions 8. However, the main part of the air flow is taken in beneath the roller. This is accomplished in that the roller 4 is provided with grooves 11, which are helically extended over the outer surface of the roller, as is best seen in the perspective view of the roller in FIG. 5. Thanks to the helical extension of the grooves 11, these will form air passages between the roller and the floor 6 and, during rotation of the roller, the air passages will successively travel along the length of the roller. Accordingly, the roller 4 will function as a rotary air barrier, which restricts and controls the air flow to the suction opening 3. Due to this it is possible to position the forward edge 10 on a rather large distance from the floor 6, which will facilitate passage of large debris items to the suction opening 3. Also, due to the rotary action of the roller, debris and dust will be swept by the roller towards the suction opening 3.

The roller, in this embodiment, comprises preferably a layer 12 of a resilient material, such as a foam material having a sealed outer surface, which is supported by an inner tube 13. The resilient layer will be deformed when encountering large debris items, which will further facilitate passing of the debris to the suction opening and subsequent withdrawal by the air flow.

The roller 4 is electrically driven by means of an electrical motor 14 and a gear wheel 15, as is seen in the view of the bottom side in FIG. 4, in which the roller is removed.

The invention claimed is:

1. A vacuum cleaner nozzle comprising:

a nozzle housing;

an outlet opening provided on the nozzle housing;

a suction opening provided on a side of the nozzle housing facing a surface to be cleaned, the suction opening being in fluid communication with the outlet opening to allow withdrawal of debris and dust from the surface through the suction opening when a suction source is connected to the outlet opening;

at least one roller connected to the housing and positioned to at least partly support the vacuum cleaner nozzle when the vacuum cleaner nozzle is positioned on the surface, the roller being formed of an essentially air tight material and being rotatable in a direction of rotation such that a portion of a surface of the roller that is facing the surface to be cleaned is moved towards the suction opening to thereby sweep debris and dust towards the suction opening; and a sealing member positioned on the nozzle housing and having a sealing portion in close apposition to at least a portion of the roller, the sealing portion partly surrounding at least a sealed portion of the roller located essentially opposite the surface to be cleaned such that the sealing portion substantially restricts air flow across the sealed portion of the roller and the roller functions as a rotatable air barrier when the suction source is connected to the outlet opening.

2. The vacuum cleaner nozzle according to claim 1, wherein the roller is positioned at a boundary edge of the vacuum cleaner nozzle.

3. The vacuum cleaner nozzle according to claim 1, wherein the sealing member comprises a roller housing that partly surrounds the roller and the sealing portion comprises an inner sub-cylindrical surface in close apposition the surface of the roller.

4. The vacuum cleaner nozzle according to claim 1, wherein the suction opening is at least partly defined by the at least one roller.

5. The vacuum cleaner nozzle according to claim 1, wherein the surface of the roller comprises a generally cylindrical outer contact surface and at least one air passage between the roller and the surface to be cleaned.

6. The vacuum cleaner nozzle according to claim 5, wherein the generally cylindrical outer contact surface comprises at least 30% of a total envelope surface of the roller.

7. The vacuum cleaner nozzle according to claim 5, wherein the generally cylindrical outer contact surface comprises at least 40% of a total envelope surface of the roller.

8. The vacuum cleaner nozzle according to claim 5, wherein the generally cylindrical outer contact surface comprises at least 50% of a total envelope surface of the roller.

9. The vacuum cleaner nozzle according to claim 5, wherein the at least one air passage travels along at least a part of the length of the roller during rotation of the roller.

10. The vacuum cleaner nozzle according to claim 5, wherein the at least one air passage comprises one or more grooves that helically extend along at least a part of the roller.

11. The vacuum cleaner nozzle according to claim 1, wherein the roller comprises at least an outer layer comprising a resilient material.

12. The vacuum cleaner nozzle according to claim 11, wherein the resilient material comprises a foamed material.

13. The vacuum cleaner nozzle according to claim 12, wherein the foamed material comprises polyurethane foam.

14. The vacuum cleaner nozzle according to claim 11, wherein the resilient material is formed with a sealed outer surface layer.

15. The vacuum cleaner nozzle according to claim 12, wherein the resilient material is formed with a sealed outer surface layer.

16. The vacuum cleaner nozzle according to claim 11, wherein the resilient material is between 5 millimeters and 25 millimeters thick.

17. The vacuum cleaner nozzle according to claim 11, wherein the resilient material is between 10 millimeters and 20 millimeters thick.

18. The vacuum cleaner nozzle according to claim 1, wherein the roller comprises an idle roller that is rotated by movement of the nozzle housing over the surface to be cleaned.

19. The vacuum cleaner nozzle according to claim 1, wherein the vacuum cleaner nozzle further comprises a motor operably connected to selectively drive the roller.

20. The vacuum cleaner nozzle according to claim 19, wherein the motor drives the roller at about 400 revolutions per minute to about 600 revolutions per minute.

* * * * *